US005759363A

United States Patent [19]

Rose

[11] Patent Number: 5,759,363

[45] Date of Patent: Jun. 2, 1998

[54] CARRYING DEVICE FOR ELECTROPLATING AND METHOD FOR IMPROVING THE DELIVERY OF CURRENT THEREIN

[76] Inventor: Millard F. Rose, 1554 S. Beech St., Cornelius, Oreg. 97113

[21] Appl. No.: 464,259

[22] Filed: Jun. 5, 1995

[51] Int. Cl.[6] ..... C25D 17/04; B05C 13/00; B05C 13/02

[52] U.S. Cl. ..... 204/297 R; 118/500; 118/503

[58] Field of Search ..... 204/279, 286, 204/297 R, 297 W; 118/500, 503

[56] References Cited

U.S. PATENT DOCUMENTS

| | | | |
|---|---|---|---|
| 737,353 | 8/1903 | Cornelius et al. | 204/297 R |
| 2,132,602 | 11/1938 | Frossard . | |
| 3,001,926 | 9/1961 | Belke | 204/297 |
| 3,540,992 | 11/1970 | Belke | 204/297 |
| 3,556,977 | 1/1971 | Elbaum | 204/297 |
| 4,014,778 | 3/1977 | Harrison | 204/297 W |
| 4,409,086 | 10/1983 | Haas et al. | 204/269 |
| 4,540,478 | 9/1985 | Mallok et al. | 204/297 W |
| 5,094,735 | 3/1992 | Lang, Jr. | 204/288 |
| 5,277,776 | 1/1994 | Borner et al. | 204/279 |
| 5,344,538 | 9/1994 | Chamberlain | 204/212 |
| 5,464,519 | 11/1995 | Tomba et al. | 204/280 |

FOREIGN PATENT DOCUMENTS

| | | |
|---|---|---|
| 3439943 | 5/1986 | Germany . |

*Primary Examiner*—Kathryn L. Gorgos
*Assistant Examiner*—Edna Wong
*Attorney, Agent, or Firm*—William A. Birdwell & Associates

[57] ABSTRACT

A carrying device for electroplating and method for improving the delivery of current therein. The carrying device comprises a core of a high conductivity material and a cladding shrunk around and sealing the core, the cladding having a second, moderate conductivity material which, however, has a high resistance to acidic corrosion. The device further comprises a plurality of electrically conductive clamping members of the second material for clamping an article to be electroplated and for delivering current thereto. Current flow to the clamping members is improved by respective pins consisting essentially of the second material, the pins being forced into respective undersized apertures provided near the clamping members.

14 Claims, 4 Drawing Sheets

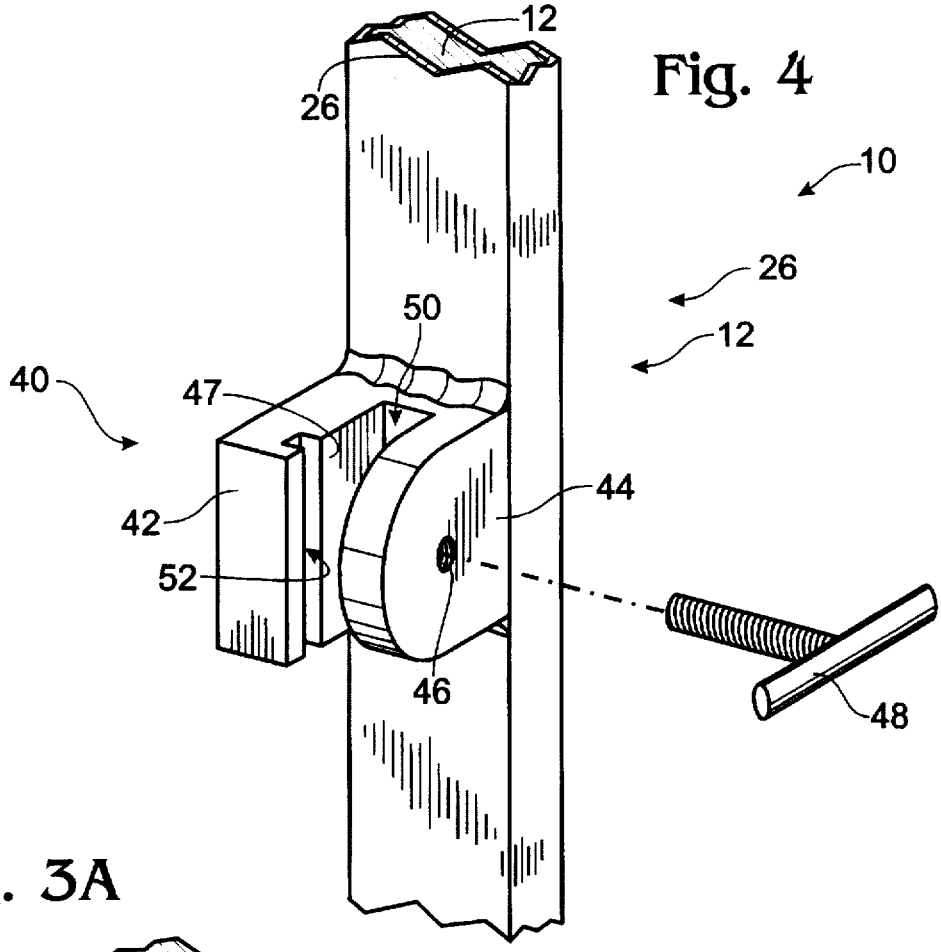
Fig. 4
Fig. 3A
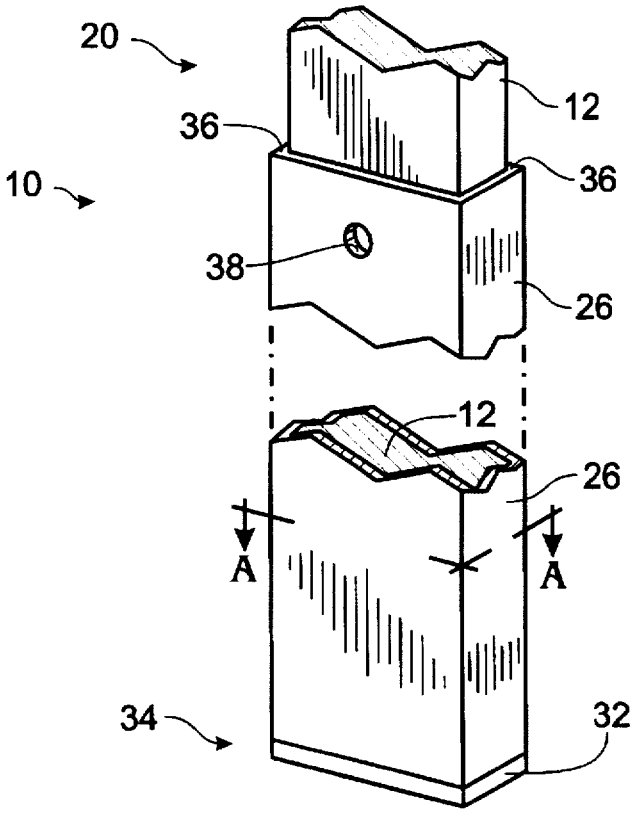
Fig. 3B
SECTION A-A
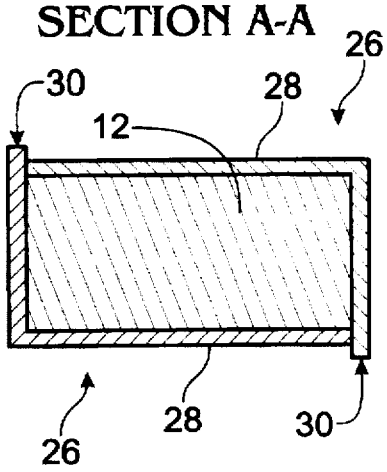

Fig. 5A
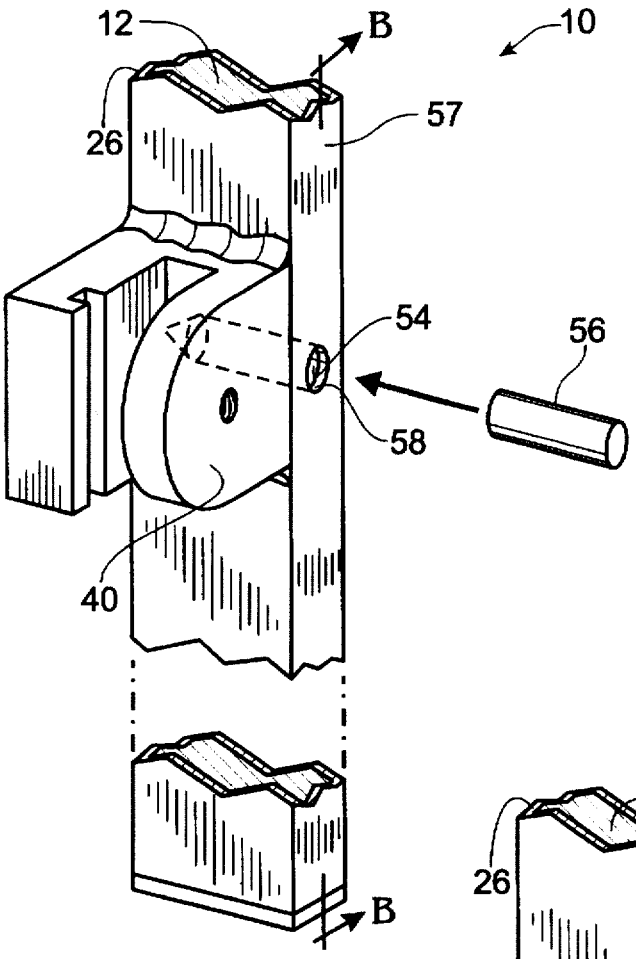
Fig. 5B
SECTION B-B
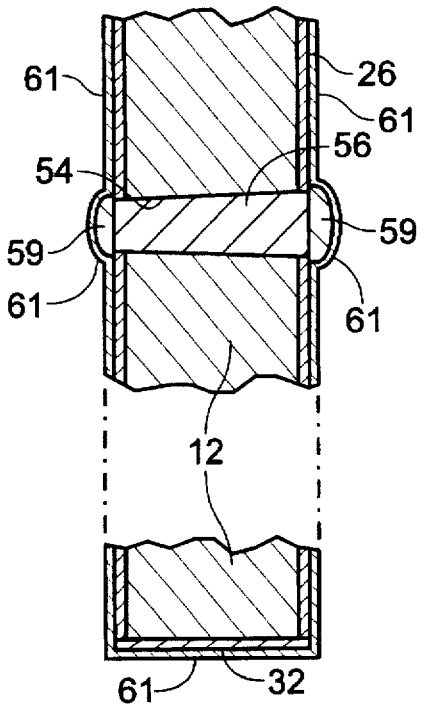
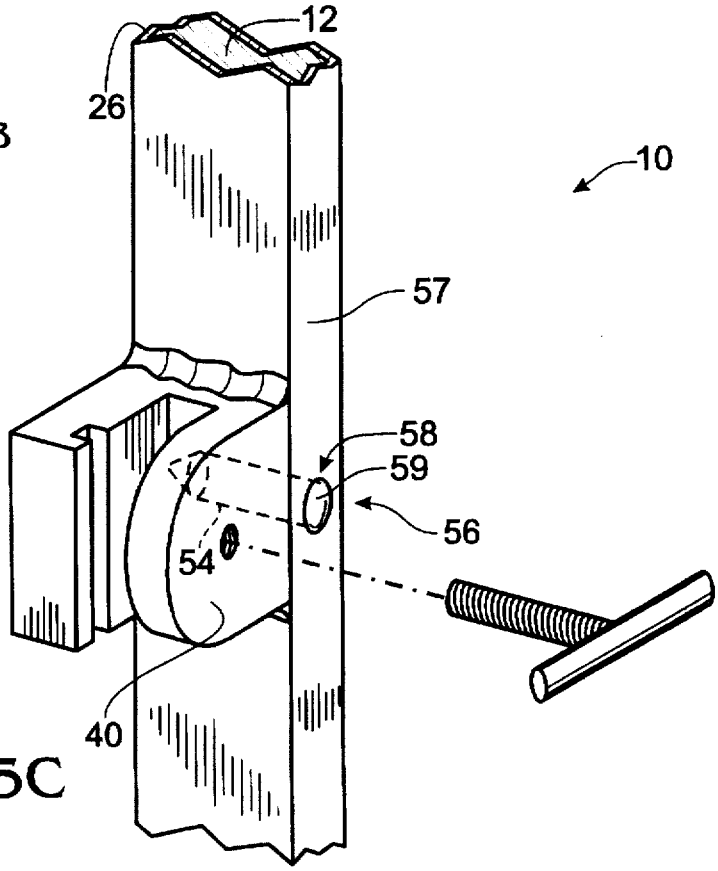
Fig. 5C

CARRYING DEVICE FOR ELECTROPLATING AND METHOD FOR IMPROVING THE DELIVERY OF CURRENT THEREIN

TECHNICAL AREA

This invention relates to a carrying device for delivering a large electrical current to an article to be electroplated while immersed in a plating solution, the device also being adapted for immersing the same article in an acidic etching solution for etching the article. More particularly, this invention relates to such a carrying device adapted for etching and electroplating panels of printed circuit boards and to methods for improving the delivery of current in such a carrying device.

BACKGROUND OF THE INVENTION

It is often necessary to deposit a metal layer onto a base metal, for example, to alter the appearance of the base metal, or to provide the base metal with improved hardness, corrosion resistance or conductivity. One common process for depositing such a layer is by electroplating. It is also often necessary to remove metal from an article. A common process for this latter purpose is to etch the article in an acidic solution. In the manufacture of some articles, such as printed circuit boards, both etching, to define a circuit pattern on a copper clad fiberglass substrate, and electroplating, to improve the solderability and contact conductivity of the circuit pattern, are often employed. Both of these processes are advantageously carried out by immersing the article in a solution. When electroplating, an electrical current must be delivered to the article while it is bathed in a plating solution, and when etching the article is bathed in an acidic etching solution. It is highly desirable that the article be carried through both processes by the same means without having to be removed from one device and transferred to another. Moreover, other processing steps are often desired to be accomplished while the article is being carried, particularly, a drying step accomplished at an elevated temperature is often advantageous. Accordingly, it has been a goal in the art to provide a carrying device adapted to (1) clamp securely an article, (2) provide for the delivery of an electrical current to the article, and (3) provide resistance to: (a) the build-up of metal on the carrying device, (b) the acids employed in the etching process, and (c) temperature cycling.

In the electroplating of panels of printed circuit boards, a number of specific difficulties arise that further challenge the design of such carrying devices. First, relatively large electrical currents must typically be used, in accord with the relatively large surface area of a panel and the relatively low voltages employed. Moreover, it is important to deliver this large current uniformly across the article, to control plating thickness, to ensure adequate coverage and at the same time to spare often precious plating metals.

Common prior art carrying devices employ a soft conductor, such as copper, a number of clamping members silver soldered to the soft conductor, and a conformal plastic coating having apertures inside the clamping members allowing metal to contact the article at selected locations within the clamping members for current carrying to the article. Since the conductor is soft, it is often not strong enough to mechanically support the article, particularly when it is in an elongate form as is common. Thence, strengthening of the conductor is often accomplished by attaching a bar or rod of stainless steel thereto with bolts. There are a number of problems with these devices have been noted. First, during temperature cycling, the dissimilar materials expand and contract at different rates and, thence, loosen the attachment bolts. This reduces the strength of the carrying device and, further, alters current carrying capacity and therefore overall conductivity.

Moreover, looseness between the parts within the conformal coating allows cracks to develop therein, which breaches its integrity. Cracks or pin-holes in the coating resulting from any number of sources, such as manufacturing defects, or as a result of aging, temperature cycling and mechanical damage during use, allow fluid to contact the conductor. Common etchants, such as nitric and sulfuric acid, attack the copper and destroy its integrity. These solutions also attack the silver solder joint supporting the clamping members, through which large currents must be conducted and by which an even distribution of current through the surface of the article is expected. Once the etchant begins to attack the material underneath the coating, the coating becomes lifted, permitting an accelerated attack. Destruction of the carrying device can be dismayingly rapid once the coating is breached.

Another means of protecting a conductor in a corrosive environment is proposed in Lang, U.S. Pat. No. 5,094,735, disclosing a central copper core which is covered by a protective layer of 316 stainless steel or titanium for corrosion resistance. The layer is said to be welded to the core; however, the welding can only occur at localized portions thereof, limiting electrical conductivity and introducing imbalances in current distribution throughout the device.

Still another means of protecting a conductor in a corrosive environment is proposed in Mallock, U.S. Pat. No. 4,540,478. "O"-rings are utilized for sealing a bus-bar within a tubular member to prevent fluid contact with the buss-bar. However, "O"-rings are prone to leakage and deterioration, particularly if they are not compressed properly or are used in hostile environments.

Other means of electrically joining an article to a carrying device for the delivery of a controlled amount of current to the article employ a screw connection in the attachment of a clamping member to a conductor bar for the delivery of current from the conductor bar to an article. See e.g., Mallock, supra., Belke, U.S. Pat. No. 3,001,926, and Lang Jr., U.S. Pat. No. 5,094,735. However, a screw attachment of a stud to a conductor bar depends sensitively for its current carrying capacity on the compressive stress at the threads, which, in turn, depends on proper torquing of the screws. Further, during temperature cycling, screws are prone to loosen so that the compressive stress and, therefore, the conductivity of the joint, will undesirably change with use.

SUMMARY OF THE INVENTION

In accordance with this invention, an improved carrying device for electroplating and method for improving the delivery of current therein is provided. The improved carrying device comprises a core consisting essentially of a first, relatively high conductivity material and a cladding shrunk around and sealing the core, the cladding consisting essentially of a second material having only moderate conductivity but having a high resistance to acidic corrosion. The carrying device further comprises a plurality of electrically conductive clamping members, consisting essentially of the second material, joined to the cladding, and an acid resistant, pliable, conformal coating over the cladding and the clamping members. However, clamp apertures are provided through the coating for exposing a high conductivity contact surface of each clamping member. Each of the clamping members include a tightening member for gripping, between the tightening member and the contact surface of the clamping member, an article to be electroplated or a portion of the article, so that electrical contact is made between the article and the clamping members. Current flow from the core to the clamping members is improved by employing respective pins consisting essentially of the second material, the pins being forced into respective undersized apertures provided near the clamping members, the apertures being formed through the cladding and either partially or completely through the core.

Therefore, it is a principal object of the present invention to provide a novel and improved carrying device for electroplating and method for improving delivery of current therein.

It is another object of the present invention to provide such a carrying device and method for improving delivery of current therein which provides a long service life.

It is yet another object of the present invention to provide such a carrying device and method for improving delivery of current therein which provides for a well controlled distribution of current to an article to be electroplated.

It is still another object of the present invention to provide such a carrying device and method for improving delivery of current therein which provides for current carrying connections which do not degrade significantly during the service life.

The foregoing and other objects, features and advantages of the invention will be more readily understood upon consideration of the following detailed description of the invention, taken in conjunction with the accompanying drawings.

BRIEF DESCRIPTION OF THE DRAWINGS

FIG. 3A is a pictorial view of a cladding of an improved carrying device for electroplating according to the present invention.

FIG. 3B is a cross-section along line A—A in FIG. 3A.

FIG. 4 is a pictorial view of an anchor of an improved carrying device for electroplating according to the present invention.

FIG. 5A is a first pictorial view of a pin aspect of the device of FIG. 4.

FIG. 5B is a section along line B—B in FIG. 5A.

FIG. 5C is a second pictorial view of the pin of FIG. 5A.

DETAILED DESCRIPTION OF THE PREFERRED EMBODIMENT

Figure 1:
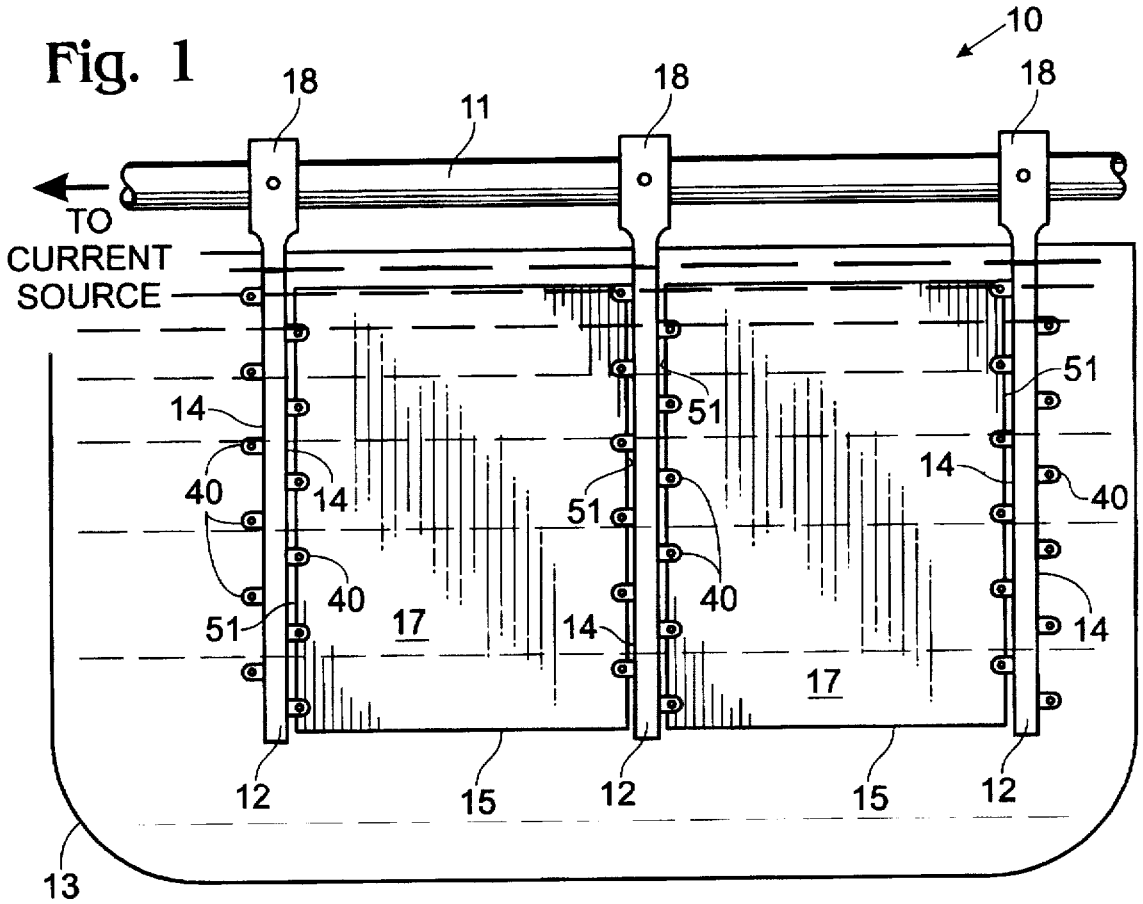
FIG. 1 is an elevation of an improved carrying device for electroplating according to the present invention.

Referring to FIG. 1, a preferred embodiment of an improved carrying device 10 for electroplating and method for improving current delivery therein according to the present invention employs a conductor, such as an elongate conductor bar 12, in conjunction with an existing buss, such as a buss bar 11, providing a cathodic current and to which the conductor bar mechanically and electrically attaches, and an existing solution bath 13, in which the conductor bar 12 is partially immersed. An article 15 to be plated is attached, mechanically and electrically, to the conductor bar 12, and this attachment may be advantageously maintained when the article is to be etched. In the electroplating of a printed circuit board panel, the conductor bar 12 is typically required to carry and deliver to the panel about 75 Amps at 2 volts and, therefore, a relatively small voltage drop—on the order of tenths of a volt or less—is tolerated. A "good" conductor of electricity, when configured as described herein, provides for this capability.

Figure 2:
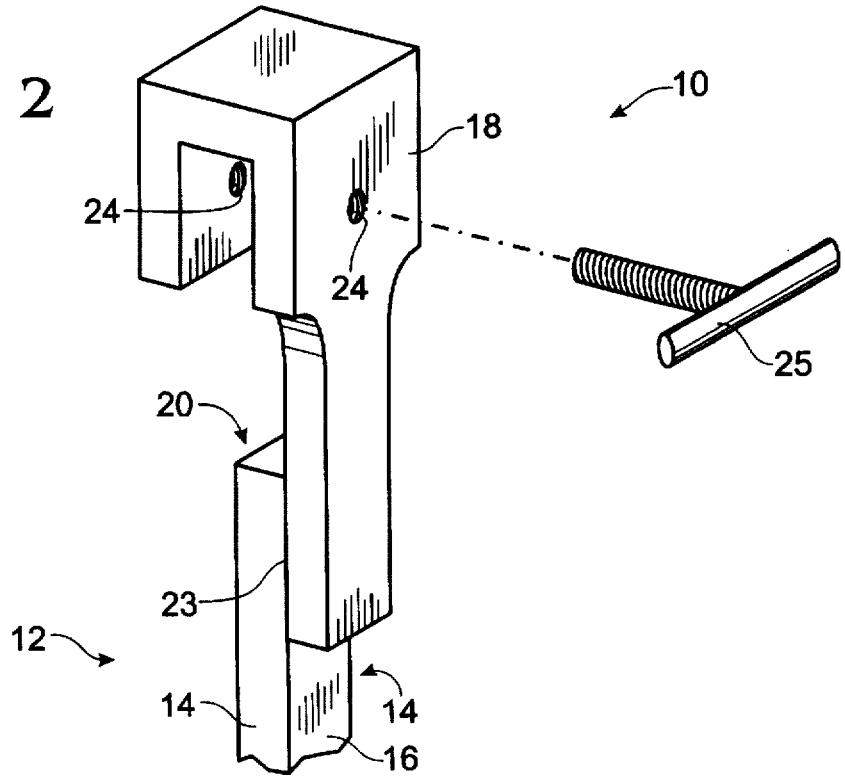
FIG. 2 is a pictorial view of a bus connector of an improved carrying device for electroplating according to the present invention.

Referring to FIGS. 1 and 2, the conductor bar 12 preferably consists essentially of a material having good electrical conductivity, such as copper. Moreover, the conductor bar preferably has a first aspect, such as defined by sides 14, which is dimensionally greater than a second aspect, such as defined by a front 16, for consuming a minimum of space in the direction of the second aspect. Which aspect is selected to be the smaller aspect depends, for example, on the manner in which multiple carrying devices are stacked or chained in the solution tank 13. Alternatively, the conductor bar 12 may simply have its first and second aspects of similar dimension, such as, for example, where the conductor bar 12 has a square cross-section.

For the plating and etching of printed circuit board panels, it is preferable that a carrying device 10 is disposed between and has attached thereto edges of two articles held substantially in the same plane, so that the sides 14 are disposed opposite one another, and so that there are "N+1" number of carrying devices for "N" number of panels. Accordingly, it is preferable that the aspect corresponding to a front 17 of the panel, e.g. front 16, is narrow in order to fit more panels into the tank 13.

The conductor bar 12 includes a buss connector 18 at a top end 20 thereof. The buss connector makes good electrical contact with the conductor bar 12, such as may be achieved by soldering or welding the buss connector 18 thereto. The buss connector is preferably adapted for releasable attachment to the buss-bar 11; however the buss connector may be adapted for attachment to other sources of electrical current. In a preferred form, the buss connector 18 is substantially of an inverted "J" shape, for hooking onto the buss-bar to allow the carrying device 10 to be hung in the solution bath disposed there beneath. The shape and size of the buss connector 18 should be such as to make a good electrical connection with the buss-bar 11. Solution in the bath does not, generally, reach the buss connector 18 or the connection thereof to conductor bar 12 when the carrying device 10 is partially immersed in the bath; accordingly, the buss connector and its connection to the conductor bar need not be particularly corrosion resistant. The buss connector 18 preferably consists essentially of a material having a good electrical conductivity, such as copper, and the connection to the conductor bar is, preferably, made by silver soldering the buss connector 18 to the conductor bar 12 at 23.

The buss connector 18 includes a threaded aperture 24 for releasably connecting the buss connector to the buss-bar 11 by means of a threaded fastener 25, such as a "T" handle bolt. The threaded fastener provides for a secure attachment of the conductor bar 12 to the buss-bar 11 as well as a good electrical connection.

Referring to FIGS. 3A and 3B, the conductor bar 12 includes a cladding 26 consisting essentially of a relatively high strength, metallic, corrosion resistant material, such as type 316 stainless steel or better. It is important that the cladding 26 make good electrical contact with the conductor bar 12 along substantially the entire of the cladding-conductor bar interface, and that the cladding provide a liquid-tight seal. A preferred method for meeting these requirements breaks the cladding 26 into two elongate sections, such as symmetrical "L" shaped elongate sections 28, and a bottom cap 32. The sections are arranged, around the conductor bar 12, to conform to the external shape thereof Moreover, when the elongate sections are so arranged, they preferably include lips 30. The lips 30 are utilized to provide material for welding, such as by inert-gas, the two elongate sections 28 to one another, thereby sealing the conductor bar 12. Moreover, when a substantially pure copper conductor bar 12 is sealed with type 316 stainless-steel cladding by welding, as is preferred, the two materials expand differently with the heat of the welding so that, upon cooling, the cladding is shrunk around the conductor bar 12, providing, by a compressive force exerted by the cladding 26 against the conductor bar 12, good electrical contact that is reliable over the service life of the carrying device 10, for improving the delivery of current within the carrying device 10. The bottom cap 32 is joined, as by welding, to the elongate sections 28 at a bottom end 34 of the conductor bar 12. Moreover, edges 36 of the elongate sections 28, are joined, as by welding, to the conductor bar 12 at the top end 20 thereof, to create a gas-tight seal at 36. While a preferred means for providing a compressive force by the cladding 26 has been described, other means, such as by driving or pressing the conductor 12 into an undersized tube of the cladding 26, may be utilized without departing from the principle of the present invention.

The cladding 26 preferably includes a vent hole 38 which provides for the escape of gases during the welding and concomitant heating. The vent hole is welded or otherwise permanently sealed during the welding while the carrying device 10 is hot so that, upon cooling, a partial vacuum is created inside the cladding 26 by contraction of the remaining gases, further improving the electrical contact. It may now be appreciated that, although the carrying device 10 will generally not be immersed in solution up to the edges 36, and therefore the joining thereof to the conductor bar 12 need not resist the etchant, the seal 36 must be gas-tight to maintain the partial vacuum.

Referring to FIG. 4, the cladding 26 includes a plurality of clamping members, such as anchors 40. The anchors 40 carry current from the conductor bar 12 through the cladding 26, to the article to be plated. Accordingly, the anchors 40 must make good electrical contact with the cladding 26 to which they are attached, must be good conductors of electricity, and must, along with the means by which they are joined to the cladding, be resistant to corrosion. Preferably, the anchors 40 consist essentially of the same material as does the cladding 26 and are joined thereto by welding.

The anchors 40 include an anvil 42 and a fastening member 44, the fastening member including a fastening aperture 46, preferably a threaded hole for receiving a threaded fastener, such as a "T" handled bolt 48. The bolt 48, when threaded into the aperture 46 of the fastening member, may abut and be tightened against a face 47 of the anvil 42. The anchors 40 include an aperture, such as slot 50, disposed between the anvil 42 and the fastening member 44, the aperture being adapted for receiving a portion of the article 15 to be plated, the article being pressed between the anvil face 47 and the bolt 48. The slot 50 is more particularly adapted to receive an edge 51 of a printed circuit board panel, as shown in FIG. 1; however, other aperture sizes and shapes may be utilized for receiving other articles, as will be readily apparent to one of ordinary skill in the art.

The anvil 42 preferably includes a canal 52 for allowing solution, particularly plating solution, to flow underneath and contact the article 15. The canal 52, thence, provides for some plating of the article in an area otherwise covered by the anvil face 47, for example, to provide for a conductive path through that area. The use of canal 52 is more advantageous to the extent the anvil is larger and therefore covers more area of the article 15.

Referring back to FIG. 1, the anchors 40 are evenly spaced along sides 14 to provide a relatively even current distribution. There are, preferably, six anchors to a side. Moreover, the anchors 40 on one of the sides 14 are staggered with respect to the anchors on the other side, also for a more even distribution of current through the carrying device 10. Fewer anchors or more anchors may be utilized, however, without departing from the principles of the invention.

Referring to FIGS. 5A, 5B and 5C, each anchor 40 has a conductor pin 56 associated therewith, for improving further the capability of the carrying device 10 to deliver a large electrical current to the article 15. The conductor bar 12 includes, in the vicinity of each anchor 40, a pin aperture 54, the pin aperture preferably extending through the conductor bar, as shown in FIG. 5B; however, it may extend only partially thereinto, as shown in FIG. 5A. The pin aperture 54 is shaped to receive a pin 56 and is undersized, with respect to the pin, to be tight-fitting with respect to the pin, so that a relatively large force is required for insertion of the pin into the aperture. Preferably, the aperture 54 is a hole of 0.355 diameter, and pin 56 has a 0.375 major diameter and tapers inwardly at a rate of 0.010 inches/inch. Moreover, the pin 56 is preferably about 2 inches long, so that its minor diameter is 0.355. The pin 56 is then inserted into the aperture 54 under a force of about 2700 pounds. Any portion of the pin 56 left protruding beyond the surface of the cladding 26 is then cut-off. This is advantageously done after the cladding 26 has been installed. The cladding 26 also includes a corresponding pin aperture 58, on only one side 14 of the cladding if the pin extends only partially into the conductor bar 12, or on both sides of the cladding if the pin extends therethrough.

The pin 56 is adapted, preferably by being cut as described above, to be substantially flush with a surface 57 of the cladding 26 when fully seated into the aperture 54 and is button welded to the surface 57 at 59 to seal the aperture 58, and to provide good electrical contact of the pin 56 to the cladding 26 in the vicinity of the anchors 40. The force of insertion of the pin into the conductor bar 12 is partially responsible for ensuring good and durable electrical contact therewith. Being proximate to the anchors 40, the pins 56 improve the delivery of electric current thereto.

Figure 6:
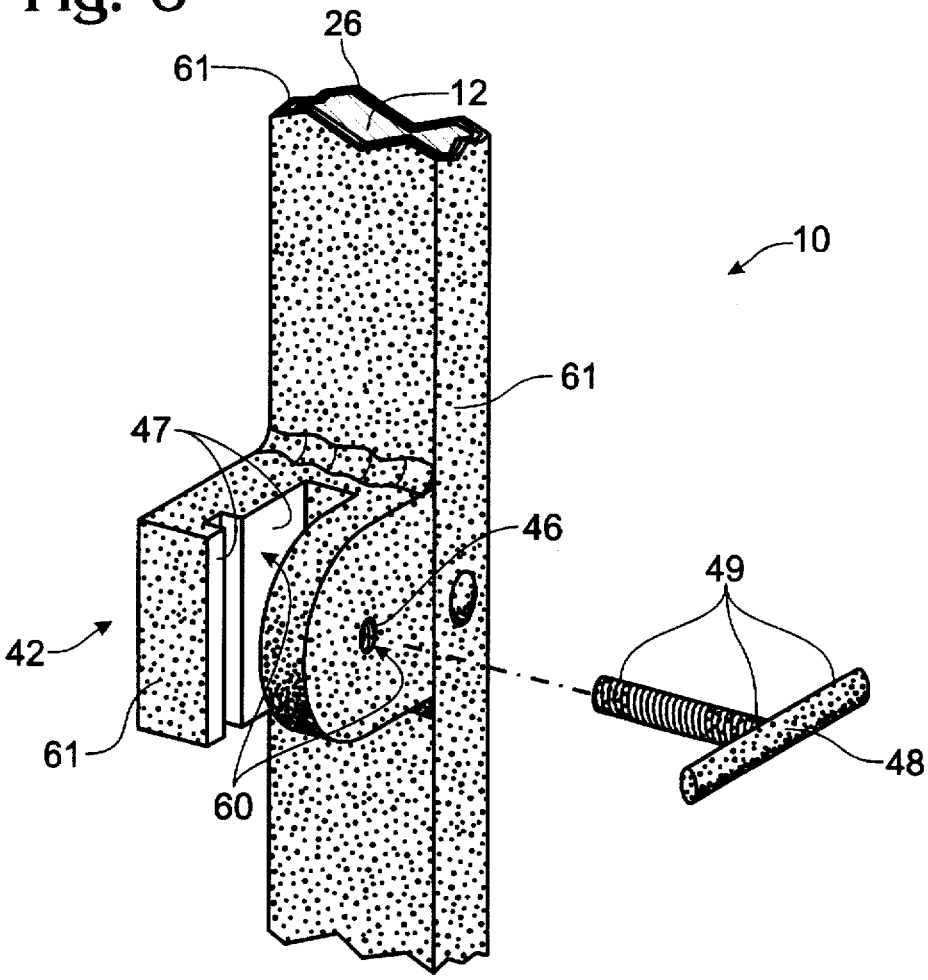
FIG. 6 is a pictorial view of a conformal coating of an improved carrying device for electroplating according to the present invention.

Referring to FIGS. 5B and 6, the carrying device 10 is conformally coated with a plastic material 61, such as by being dipped in plastisol, which is allowed to coat the entire device below the line of immersion in the tank 15, except at apertures 60. Apertures 60 allow for an opening to the cladding at the face 47 of the anvil 42, the aperture being flush thereto for providing electrical contact of the article 15 with the face 47 when tightened against the anvil with the bolt 48. Apertures 60 further allow for an opening at an interior surface 47 of the fastening aperture 46, for allowing the bolt 48 to contact threads therein. Moreover, the bolt 48 is preferably partially coated with a plastic material at portions 49 thereof that will be exposed to bath solution when the bolt is fastened against the article to be plated.

Figure 7A:
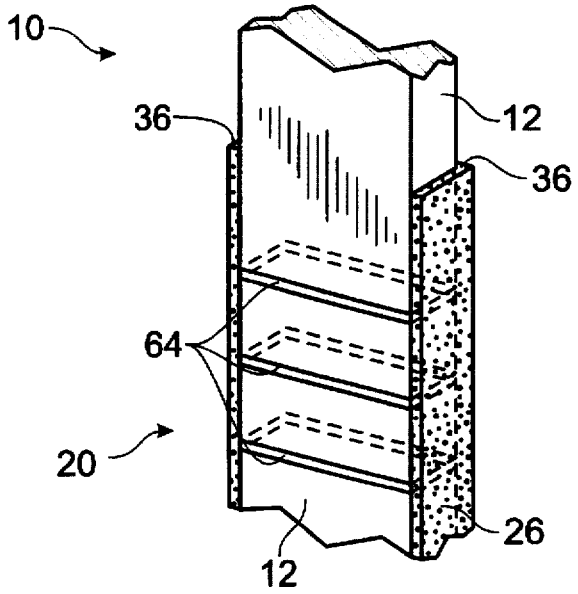
FIG. 7A is a pictorial view of a spaced-apart groove of an improved carrying device for electroplating according to the present invention, with cladding cut-away.
Figure 7B:
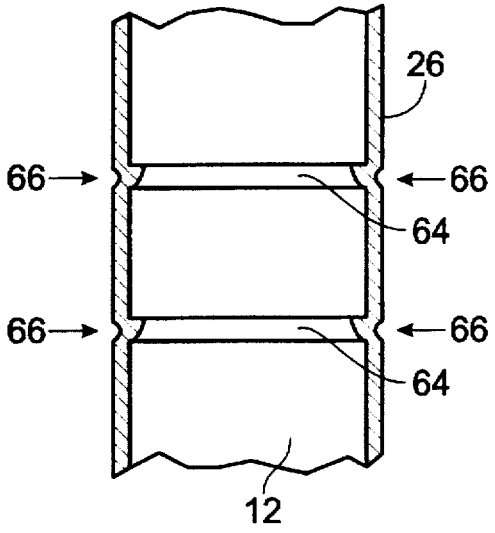
FIG. 7B is a side view of the spaced-apart groove of FIG. 7A, with cladding cut-away.

Referring to FIGS. 7A and 7B, both showing the cladding 26 cut-away for clarity, the top end 20 of the conductor bar 12 preferably includes spaced-apart parallel grooves 64, around the circumference thereof. The cladding 26 lying atop these grooves is depressed into those grooves, at 66, the effect of the grooves and the depressions in the cladding being to allow for some thermally induced displacement of the cladding 26 with respect to the conductor bar 12 in an area where such minimal displacement is not so critical.

Referring back to FIGS. 1, 2 and 4, the carrying device 10 is preferably utilized by hooking the buss connector 18 over the buss-bar 22 and, at the threaded aperture 24, bolting the connector thereto by means of a threaded fastener, such as a "T" handle bolt. Preferably, a plurality of carrying devices 10 are so attached to the bus-bar, for carrying a plurality of printed circuit board panels 15. Edges 51 of the panels 15 are inserted into the slots 50 of the anchors, an edge 51 of one panel being fitted into the slots of all the anchors on one side of the carrying device, and an edge 51 of another panel being fitted into the slots of all the anchors on an opposite side of the carrying device. Thence, two carrying devices 10 contribute to the carrying of one panel, while, with the exception of the carrying devices 10 at both ends of a train of panels, one carrying device 10 contributes to the carrying of two panels. The panels are fastened into the carrying device at the anchors by tightening a threaded fastener 48, carried by the fastening member 44 through the fastening aperture 46, against the anvil 42. Lower portions of the carrying devices 10 and the entire portion of the panels 15 desired to be electroplated or etched are subsequently immersed in a selected solution. When it is desired to electroplate, the solution consists essentially of a metallic salt and the buss-bar is energized to provide large currents at low voltages, typically about 75 amps at 2 volts through each carrying device 10. Means of completing the circuit within the solution are thence also provided as is well known in the art. When it is desired to etch, the buss-bar 11 is not energized and the solution consists essentially of an acid, such as nitric or hydrofluoric acid.

A specific carrying device 10 adapted for electroplating of a particular article 15 and a method for improving the delivery of current therein according to the present invention has been described above as preferred, however, it will be apparent to one of ordinary skill in the art that other configurations may be advantageous when plating or etching other articles.

Moreover, the terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A device for carrying an article to be electroplated, comprising:

a conductor, mechanically and electrically attachable to a source of electric current;

a corrosion resistant, electrically conductive cladding disposed around said conductor for sealing and making electrical contact with said conductor, said conductor and said cladding each having a corresponding respective aperture therein; and an electrically conductive pin disposed in said apertures in said cladding and said conductor, said pin disposed in said aperture of said conductor under compressive stress, said pin contacting said conductor and said cladding to provide electrical continuity therebetween, wherein said compressive stress being employed to increase the electrical continuity therebetween.

2. The carrying device of claim 1, wherein the electrical conductivity of said conductor is greater than the electrical conductivity of said cladding.

3. The carrying device of claim 1, wherein said cladding exerts a compressive force against said conductor.

4. The carrying device of claim 3, wherein said cladding comprises two symmetrical sections wherein, the symmetrical sections are joined so as to shrink fit around said conductor.

5. The carrying device of claim 1, further comprising an electrically conductive clamping member, said clamping member depending from said cladding for holding and providing electrical current to the article.

6. The carrying device of claim 5, wherein said pin is disposed proximate said clamping member for improving the electrical conductivity of said clamping member.

7. The carrying device of claim 1, further including a vent aperture in said cladding for releasing of gases, wherein said vent aperture is optinally sealed after the release of the gases.

8. A device for carring an article to be electroplated, comprising:

a conductor, mechanically and electrically attachable to a source of electric current;

a corrosion resistant, electrically conductive cladding disposed around said conductor for sealing and making electrical contact with said conductor, said conductor and said cladding each having a corresponding respective aperture therein;

an electrically conductive pin disposed in said apertures in said cladding and said conductor, said pin disposed in said aperture of said conductor under compressive stress, said pin contacting said conductor and said cladding to provide electrical continuity therebetween; and a substantially conformal plastic coating.

9. A device for carrying an article to be electroplated, comprising:

a conductor, mechanically and electrically attachable to a source of electric current;

a corrosion resistant, electrically conductive cladding, disposed around said conductor for sealing and making electrical contact with said conductor, said conductor and said cladding each having a corresponding respective aperture therein;

an electrically conductive pin disposed in said apertures in said cladding and said conductor, said pin disposed in said aperture of said conductor under compressive stress, said pin contacting said conductor and said cladding to provide electrical continuity therebetween; and an electrically conductive clamping member, said clamping member depending from said cladding for holding and providing electrical current to the article, wherein said clamping member includes an anvil and a threaded fastener adapted for tightening the article against said anvil.

10. The carrying device of claim 9, further comprising a substantially conformal plastic coating, said coating having an aperture disposed at a face of said anvil, wherein said aperture is flushed with said face providing for electrical contact of the article with said face when tightened.

11. A device for carrying an article to be electroplated, comprising:

a conductor, mechanically and electrically attachable to a source of electric current;

a corrosion resistant, electrically conductive cladding disposed around said conductor for sealing and making electrical contact with said conductor, said conductor and said cladding each having a corresponding respective aperture therein;

an electrically conductive pin disposed in said apertures in said cladding and said conductor, said pin disposed in said aperture of said conductor under compressive stress, said pin contacting said conductor and said cladding to provide electrical continuity therebetween; and a plurality of spaced-apart, substantially parallel grooves in said conductor, wherein said cladding includes a plurality of depressions corresponding to and depressed into said grooves, for absorbing thermal displacement of said cladding with respect to said conductor.

12. A device for carrying an article to be electroplated, comprising:

a conductor, mechanically and electrically attachable to a source of electric current;

a corrosion resistant, electrically conductive cladding disposed around said conductor for sealing and making electrical contact with said conductor, said conductor and said cladding each having a corresponding respective aperture therein;

an electrically conductive pin disposed in said apertures in said cladding and said conductor, said pin disposed in said aperture of said conductor under compressive stress, said pin contacting said conductor and said cladding to provide electrical continuity therebetween, wherein said conductor is elongate, the device including anchors depending from said cladding for holding and providing electrical current to the article, said anchors having an anvil and a threaded fastener adapted for tightening the article against said anvil, six equally spaced first anchors disposed on one side of said conductor, and six equally spaced, corresponding, second anchors disposed on an opposite side of said conductor.

13. A device for carrying an article to be electroplated, comprising:

a conductor, mechanically and electrically attachable to a source of electric current;

a corrosion resistant, electrically conductive cladding disposed around said conductor for sealing and making electrical contact with said conductor, and a plurality of spaced-apart, substantially grooves in said conductor, wherein said cladding includes a plurality of depressions corresponding to and depressed into said grooves, for absorbing thermal displacement of said cladding with respect to said conductor.

14. A device for carrying an article to be electroplated, comprising:

a conductor, mechanically and electrically attachable to a source of electric current;

a corrosion resistant, electrically conductive cladding disposed around said conductor for sealing and making electrical contact with said conductor, wherein the electrical conductivity of said conductor is substantially greater than the electrical conductivity of said cladding, wherein the coefficient of expansion of said conductor is less than the coefficient of expansion of said cladding, and wherein said cladding exerts a compressive force on said conductor, to increase the electrical continuity between said cladding and said conductor, said cladding having two sections which are disposed adjacent respective peripheral surface portions of said conductor, abut one another and are welded together so that, after welding, they exert said compressive force on said conductor.

* * * * *

UNITED STATES PATENT AND TRADEMARK OFFICE

CERTIFICATE OF CORRECTION

PATENT NO. : 5,759,363
APPLICATION NO. : 08/464259
DATED : June 2, 1998
INVENTOR(S) : Millard F. Rose It is certified that error appears in the above-identified patent and that said Letters Patent is hereby corrected as shown below:

Claim 1, Column 8, line 6 delete “being” and insert --is--.

Claim 7, Column 8, line 26 delete “optinally” and insert --optionally--.

Signed and Sealed this

Thirty-first Day of July, 2007

JON W. DUDAS
*Director of the United States Patent and Trademark Office*